United States Patent [19]

Hirakawa et al.

[11] Patent Number: 4,582,747

[45] Date of Patent: Apr. 15, 1986

[54] DUST-PROOF FABRIC

[75] Inventors: Tadashi Hirakawa, Kusatsu; Mamoru Tsumoto, Ibaraki, both of Japan

[73] Assignee: Teijin Limited, Osaka, Japan

[21] Appl. No.: 701,557

[22] Filed: Feb. 14, 1985

[30] Foreign Application Priority Data

Feb. 16, 1984 [JP] Japan ..... 59-26132
Jun. 7, 1984 [JP] Japan ..... 59-115391

[51] Int. Cl.[4] ..... D03D 15/00

[52] U.S. Cl. ..... 428/229; 55/528; 55/DIG. 43; 55/DIG. 45; 428/311.1; 428/311.5; 428/315.5; 428/315.7; 428/317.9; 428/401; 428/922; 428/374

[58] Field of Search ..... 428/229, 311.1, 311.5, 428/315.5, 315.7, 317.9, 922; 55/DIG. 43, DIG. 45, 528

[56] References Cited

U.S. PATENT DOCUMENTS 3,986,530 10/1976 Maekawa ..... 55/DIG. 43
4,025,679 5/1977 Denny ..... 55/528
4,499,139 2/1985 Schortmann ..... 428/315.5
4,520,066 5/1985 Athey ..... 428/311.5
4,539,255 9/1985 Sato et al. ..... 428/315.5
4,540,625 9/1985 Sherwood ..... 428/311.5
4,547,423 10/1985 Kojima et al. ..... 428/317.9

FOREIGN PATENT DOCUMENTS 104548 6/1985 Japan .

*Primary Examiner*—James C. Cannon
*Attorney, Agent, or Firm*—Burgess, Ryan & Wayne

[57] ABSTRACT

A dust-proof fabric having an excellent dust-collecting efficiency and dust-preventing property including a plurality of filament yarns having a thickness of 20 to 400 denier and consisting of a plurality of individual filaments having a denier of 3.5 or less. The fabric has a number of pores formed therein and exhibits an air permeability of 0.3 to 10 ml/cm$^2$/sec. In the fabric, the proportion of the integrated volume of pores having a size of 43 μm or more to the entire integrated volume of all the pores in the fabric is 40% or less.

12 Claims, 3 Drawing Figures

DUST-PROOF FABRIC

BACKGROUND OF THE INVENTION

1. Field of the Invention

The present invention relates to a dust-proof fabric. More particularly, the present invention relates to a dust-proof fabric useful for preparing dust-proof clothing to be used in clean rooms, for example, industrial clean rooms, biological clean rooms and surgical operation rooms, which are effective for preventing contamination of the human body or specific articles with dust generated from machines and human personnel.

The dust-proof fabric of the present invention generates dusts therefrom in a very reduced amount and can collect dust at a high efficiency. Also, the dust-proof fabric of the present invention exhibits an antistatic property which prevents excess attraction of dust and prevents breakdowns of semiconductor devices.

2. Description of the Related Art

It is known that to prevent undesirable generation of dust from clothing of workers or operators in industrial clean rooms and other clean rooms by use of dust-free clothing (inclusive of sterile clothing). The dust-free clothing is produced from woven or knitted fabrics consisting of synthetic filament yarns or nonwoven fabrics consisting of spun bonded continuous filaments. Also, it is known to prevent undesirable adhesion of dust on the dust-free clothing by antistatic treatment applied to the dust-free clothing.

With recent increase of precision, integration, and miniaturization in the semiconductor industry and precision machine industry and in the fields of the bioindustry and medical industry, clean rooms have come into broad use. It is especially required at the present time that the cleanliness of air in a clean room be further increased. For example, in the field of semiconductors, the integration degree in LSI's is being increased to 256 K-bits from 64 K-bits. It is expected that the integration degree will be elevated to 1 M-bit (megabit) or higher in the not too distant future. It is ordinarily considered that the air cleanness degrees of clean rooms required for these integration degrees are class 1000–100, class 100–10, and class 10 or lower. It also is considered that the size of dust to be removed becomes smaller as the air cleanness is elevated. Namely, minute dust or bacteria cause defects in products. Hence, the higher the air cleanness, the more important the prevention of generation of dust. Accordingly, with elevation of the cleanness of a clean room, enhancement of the dust-preventive effect in dust-free clothing is required.

The largest dust-generating sources in a clean room are the human personnel themselves. The contamination level in the clean room is elevated by dust generated from the personnel. The dust-generating sources of human personnel include (1) the physical bodies, (2) undergarments, and (3) outer dust-free clothing. Generation of dust from the clothing can be greatly reduced by using a filament yarn and periodically cleaning the dust from the clothing. The main sources of dust are therefore the body and undergarments of the personnel. Accordingly, it is necessary that dust generated from the body or undergarments be prevented from being discharged outside.

Therefore, the clothing should be made or dust-proof fabric which prevents discharge of dust outside from the clothing. Of course, it must be excellent in adaptability, durability, and comfort. As means for preventing discharge of dust, there has been proposed a fabric with a low dust permeability, that is, a high dust-collecting property (high filtering property). Conventional woven and knitted fabrics, however, have a high dust permeability (low dust-collecting efficiency). Certain spun-bond non-woven fabrics have low dust permeability, but they also have a paper-like stiff touch and poor washing resistance.

Recently, as means for reducing the dust permeability of a woven or knitted fabric and preventing discharge of dust, the dust-free clothing has been made from a fabric obtained by resin-coating a woven or knitted fabric of synthetic filaments or a fabric obtained by laminating a film on a woven or knitted fabric of synthetic filaments. According to this technique, the fabric is coated, e.g., with a water-proof moisture-permeable resin such as a polyurethane resin to reduce the air permeability while maintaining a certain moisture permeability. Clothing of this type does not allow permeation of air, and resists, permeation of dust. However, such clothing is is defective in various points. For example, since the moisture permeability and air permeability are poor, the clothing becomes uncomfortable on wearing. A resin-coated (or laminated) fabric is also ordinarily poor in durability, washing resistance, and abrasion resistance. Clothing to be used in a clean room is frequently subjected to dry cleaning, but a water-proof moisture-permeable resin is ordinarily poor in dry cleaning resistance. In short, a fabric for dust-free clothing, which is satisfactory in dust-collecting efficiency, wearing properties (moisture permeability and air permeability), wearing durability, washing resistance, abrasion resistance and antistatic property has not been developed.

SUMMARY OF THE INVENTION

An object of the present invention is to provide a dust-proof fabric having an enhanced dust-preventing property useful for producing dust-free clothing for clean rooms having a highly enhanced air cleanness.

The above-mentioned object can be attained by the dust-proof fabric of the present invention, which includes a plurality of filament yarns having a denier of from 20 to 400 and consisting of a plurality of individual filaments having a denier of 3.5 or less. The fabric has a number of pores formed therein and exhibits on air permeability of from 0.3 to 10 ml/cm$^2$/sec. In the fabric, the integrated volume of the pores having a size of 43 $\mu$m or more corresponds to 40% or less of the entire integrated volume of all the pores.

The dust-proof fabric of the present invention is preferably in the form of a woven fabric composed of a plurality of warp and wefts consisting of the filament yarns. Also, it is preferable that the warp and/or wefts contain electrically conductive filament yarns having an electric resistivity of $10^{10}\Omega$/cm or less and arranged at intervals of from 3 mm to 50 mm.

DESCRIPTION OF THE PREFERRED EMBODIMENTS

Figure 1:
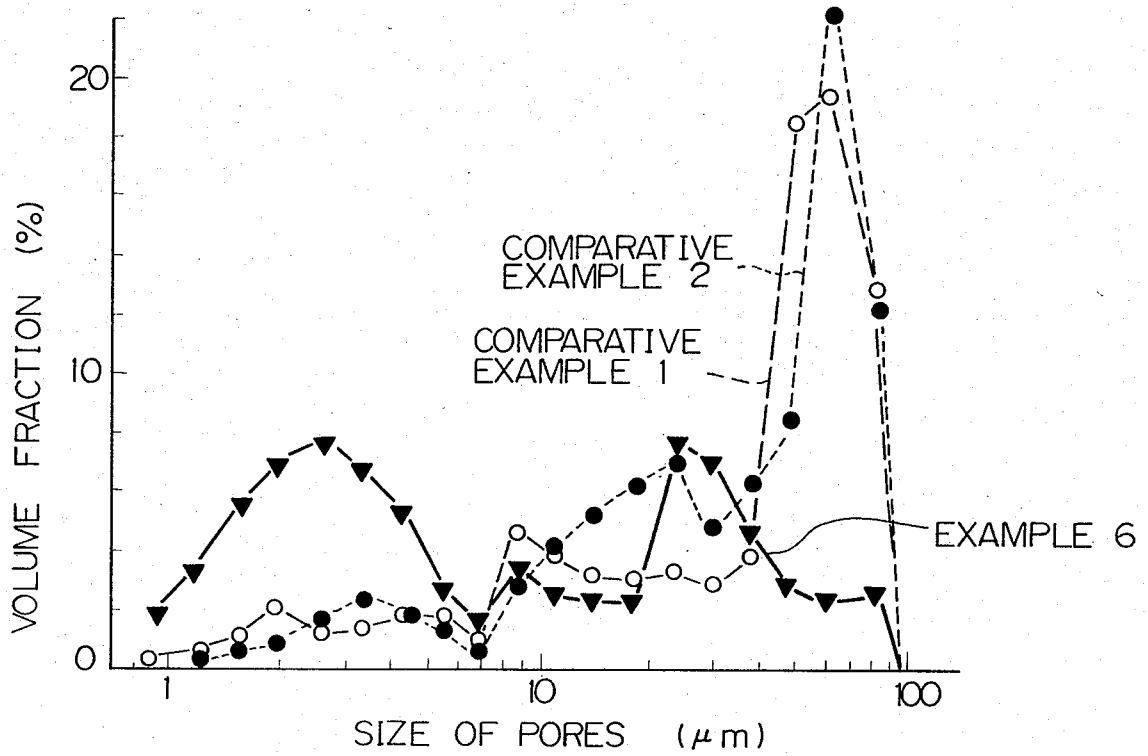
FIGS. 1, 2, and 3 are graphs showing the relationship between the size in $\mu$m of pores in the fabrics of the present invention and comparative fabrics and the volume fraction of the pores having a size in percent based on the entire integrated volume of all the pores in each fabric.

With a view to developing a fabric for dust-free clothing satisfactory in all of the foregoing properties, the inventors made extensive research on the structure of such a fabric, practical properties such as the dust-collecting efficiency and durability characteristics, the antistatic property, and the dust-preventive property of dust-free clothing on actual wear. As a result, they obtained a novel finding about the mechanism of generation of dusts and invented a fabric for anti-static dust-free clothing having a novel structure. It has been considered that generation of dust from human personnel would be reduced in dust-free clothing composed of a fabric having a low dust permeability. Improvements of fabrics for dust-free clothing have been made based on this idea. However, there has been no knowledge about the relation between the dust permeability of the fabric for a dust-free clothing and generation of dust in the dust-free clothing on actual wear. It has not been proved whether the above idea is correct. Moreover, the relation between the structure of a fabric for dust-free clothing and the dust-collecting efficiency has not been investigated in detail. It has not been clarified what structure of a dust-proof fabric would be effective for increasing the dust-collecting efficiency.

The inventors produced, on an experimental basis, various types of dust-proof clothing from various types of dust-proof fabrics differing in dust permeability and air permeability and checked the amount of dust generated from the clothing when personnel wearing the clothing worked. As a results, they found surprisingly, that, in case of dust-free clothing composed of a resin-coated or laminated fabric having no substantial dust permeability, the amount of generated dust is large and when the dust permeability or air permeability is within a certain range, the amount of generated dust is reduced to a minimum. More specifically, in case of a fabric having no substantial air permeability, contaminated air having a high dust concentration within dust-free clothing does not permeate the fabric but leaks out from openings of the clothing such as the edge of the sleeves or the neck portions. In contrast, in case of a dust-free clothing composed of a fabric having an appropriate air permeability and a high dust-collecting efficiency, when contaminated air within the space surrounded by the dust-free clothing permeates the fabric, the dust in the contaminated air is collected by the dust-proof fabric. Therefore, it is considered that leakage of contaminated air from openings is reduced, resulting in decreased dust. Namely, reduction of the dust permeability by reducing the air permeability of a fabric is insufficient for drastically reducing dust generated from personnel. It is necessary that the dust permeability be low and appropriate air permeability be given to the fabric. Moreover, since a conventional fabric does not have a sufficient antistatic property, the fabric is readily charged and dust is attracted to the clothing, with the result that generation of dust from the clothing becomes conspicuous or semiconductors are broken by discharges from the charged fabric. Accordingly, it has been considered preferable to impart an antistatic effect in addition to the above-mentioned dust-preventing property.

In the dust-proof fabric of the present invention, the material of the multifilament yarns is not particularly critical. For example, the material of the multifilament yarns may be selected from polyesters, such as polyethylene terephthalate (PET) and polybutylene terephthalate (PBT); polyamides, for instance, nylon-6, nylon-66, and aromatic polyamides; polyolefins, for example, polyethylene and polypropylene; polyvinyl polymers, for instance, polyvinyl alcohol, polyvinyl chloride, and polyacrylonitrile; rayon; cellulose acetate; silk; and glass. The multifilament yarn may be composed of one of these materials or composed of two or more of these materials. In some case, good chemical resistance is required for dust-free clothing in addition to functions ordinarily required for clothing. Furthermore, it is often required that the dust-free clothing be excellent in durability, washing resistance, and dry cleaning resistance. It is preferred that a material capable of satisfying these requirements in a broad range be used. For example, polyesters such as PET and PBT and polyamides such as nylon-6 and nylon-66 are preferred.

The denier of the individual filaments in the multifilament yarns should be 3.5 or less. The denier of the filament yarns should be in the range of from 20 to 400.

Generally, as described hereinafter, the dust-collecting (filtering) property of the fabric is enhanced with an increase of the ratio of the integrated volume of the pores formed between the individual filaments to the entire integrated volume of all the pores in the fabric. In the case of a filament bundle, that is, a multifilament yarn, the sum of the surface areas of the individual filaments in the bundle having a unit weight increases with a decrease of the denier of the individual filaments. That is, the smaller the denier of the individual filaments in the bundle, the smaller the size of the pores formed between the individual filaments and the larger the integrated volume of the pores formed between the individual filaments in the bundle. Therefore, it is preferable that the individual filaments have a denier as small as possible, that is, of 1.5 denier or less, more preferably about 0.5 or less. The small denier of the individual filaments of 1.5 or less is effective for creating a soft touch of the resultant fabric.

In the case where the integrated volume of the pores formed between the multifilament yarns (bundles) is reduced by increasing the densities of warps and wefts in the fabric, the dust-filtering property of the fabric closely depends on the integrated volume of the pores formed between the individual filaments. In order to enhance the dust-filtering property of the fabric, it is very important to use individual filaments having a denier as small as possible.

An ultrafine multifilament yarn consisting of individual filaments having an extremely smaller denier than that of conventional multifilament yarns is known. Any of the known ultrafine multifilament yarns can be utilized for the present invention. The ultrafine multifilament yarn usable for the present invention can be produced, for example, by a process for producing peel-separable composite filaments, as disclosed in Japanese Unexamined Patent Publication (Kokai) Nos. 51-70366, 51-130317, 51-58578, and 58-186663 and Japanese Examined Patent Publication (Kokoku) No. 56-16231, by a process for producing islands-in-a sea type composite filaments, as disclosed in Japanese Examined Patent Publication (Kokoku) Nos. 45-6297, 44-18369, and 58-22126, or by a direct spinning process as disclosed in Japanese Unexamined Patent Publication (Kokai) Nos. 54-30924, 54-73915, 55-1338, and 55-152809. These ultra-fine multifilament yarns can be converted into woven and knitted fabrics according to known methods.

The cross-sectional profile of the individual filaments is not particularly limited to any specific shape. The individual filaments may have a circular (regular) or a non-circular (irregular) cross-sectional profile such as a triangular, cruciform, hollow, or a star-shaped cross-sectional profile. Of course, a combination of the regular and irregular cross-sectional profiles may be adopted. In order to increase the integrated volume of the pores formed between the individual filaments, use or incorporation of irregular individual filaments having an irregular cross-sectional profile is sometimes advantageous.

The thickness (total denier) of the warps or wefts should be in a range of from 20 to 400. If the total denier of the warps or wefts exceeds 400, the resultant fabric becomes excessively thick and the touch of the fabric is degraded. Moreover, the clearance between the warps or wefts is increased, and the filtering property of the fabric is reduced. When the total denier of the warps or wefts is smaller than 20, the resultant fabric is too thin, and therefore, the strength or durability of the fabric is insufficient and the filtering property of the fabric is unsatisfactory. It is especially preferred that the total denier of the warps or wefts be in a range of from 50 to 250.

The thickness of the fabric is preferably in a range of from 0.05 mm to 0.40 mm. If the thickness of the fabric is larger than 0.40 mm, the filtering property of the fabric increases with increase of the thickness but, sometimes, the resulting dust-free clothing is too heavy and is not comfortable to wear. If the thickness of the fabric is smaller than 0.05 mm, since the fabric is too thin, the strength, the durability, and the filtering property of the resultant fabric are sometimes unsatisfactory.

In connection with the form of the multifilament yarn, a flat yarn or textured bulky yarn may be used. In case of bulky yarns, for instance, a false-twisted yarn or a yarn composed of individual filaments different in the shrinkability, the looseness between the individual filaments is ordinarily larger than that between the filaments in a flat yarn. Accordingly, in a fabric composed of a textured bulky yarn, the integrated volume of the pores formed between the dividual filaments is larger than that in a fabric composed of flat yarns and the filtering property of the textured bulky yarn fabric is generally excellent. Therefore, in a woven or knitted fabric composed of separable ultra-fine filaments in which one filamentary component has a higher shrinkability than that of the other filamentary component, the filtering property of the resultant fabric is very excellent because of the very small denier of the peel-separated filaments, the high bulkiness of the fabric, and a large integrated volume of the pores between the individual ultra-fine filaments.

The dust-proof fabric of the present invention is in the form of a woven fabric selected from, for example, plain weaves, twill weaves and satin weaves, or a knitted fabric selected from, for instance, weft (circular)-knitted fabrics and warp-knitted fabrics. In consideration of mechanical strength, durability, stretchability, rigidity, air-permeability and facility of treatments to be applied to the fabric, the dust-proof fabric of the present invention is preferably in the form of a woven fabric, especially, a plain weave or twill weave.

The pores in the fabric are classified into those of three types, that is, (1) pores (intra-filament pores) formed on the peripheral surfaces of the individual filaments, (2) pores (inter-filament pores) formed between the individual filaments, and (3) pores (interfilament bundle pores) formed between the filament bundles, that is, the multifilament yarns.

The integrated volume of the pores having a certain size can be measured by a fluid-permeation method, electron microscopic method, or a mercury intrusion method. The mercury intrusion method using a porosimeter is most preferred to precisely and easily determine the volume fraction of the pores having a certain size. In the present invention, the distribution of the volumes fraction of the pores in the fabric is measured by the mercury intrusion method.

The method for measuring the size of the pores will now be briefly described.

Mercury does not substantially wet all substances. Accordingly, mercury does not intrude into pores unless mercury is pressed into the pores. The relation between the pore size (diameter) and the pressure to be applied to mercury is represented by the following equation (1):

$$P \cdot D = -4\sigma \cos \theta \quad (1)$$

wherein P stands for the pressure applied to mercury, D stands for the size (diameter) of the pore, provided the pore is in the form of a cylinder, $\sigma$ represents the surface tension of mercury, and $\theta$ represents the contact angle of the specimen to be tested with mercury.

If P, $\sigma$, and $\theta$ are known, the pore size D can be determined from the above equation (1). Moreover, the volume of mercury penetrated into the specimen represents the integrated volume of the pores, and the pore size distribution can be obtained from the pressures applied stepwise to mercury and the volumes of mercury penetrated into the specimen.

Figure 2:
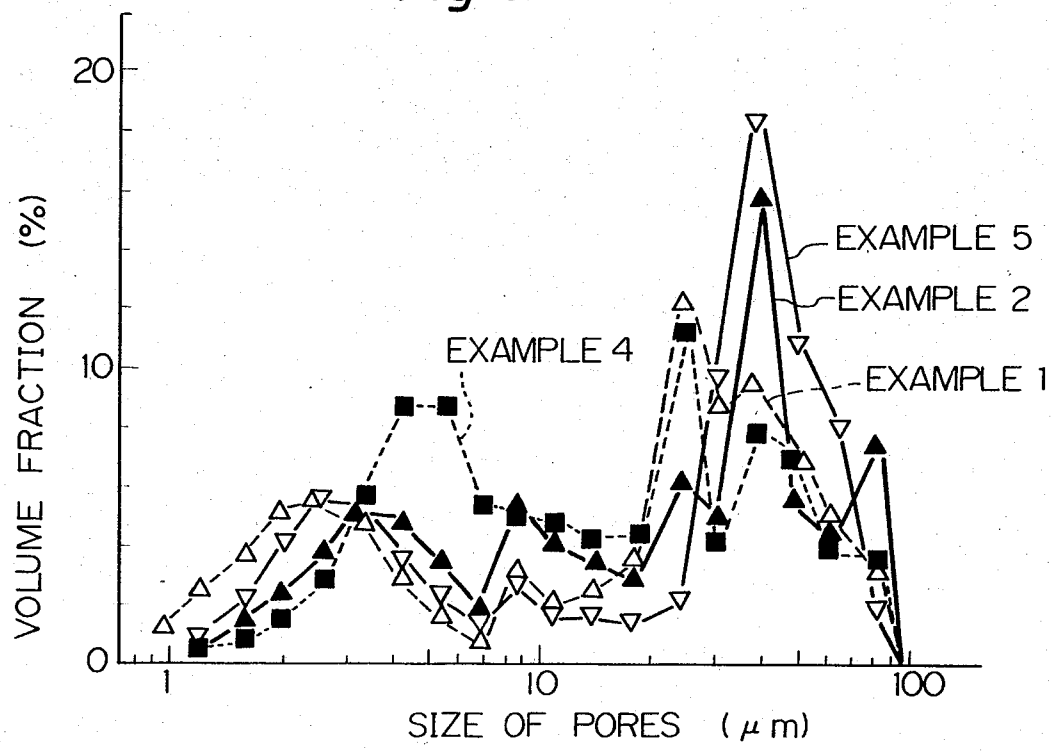
Figure 3:
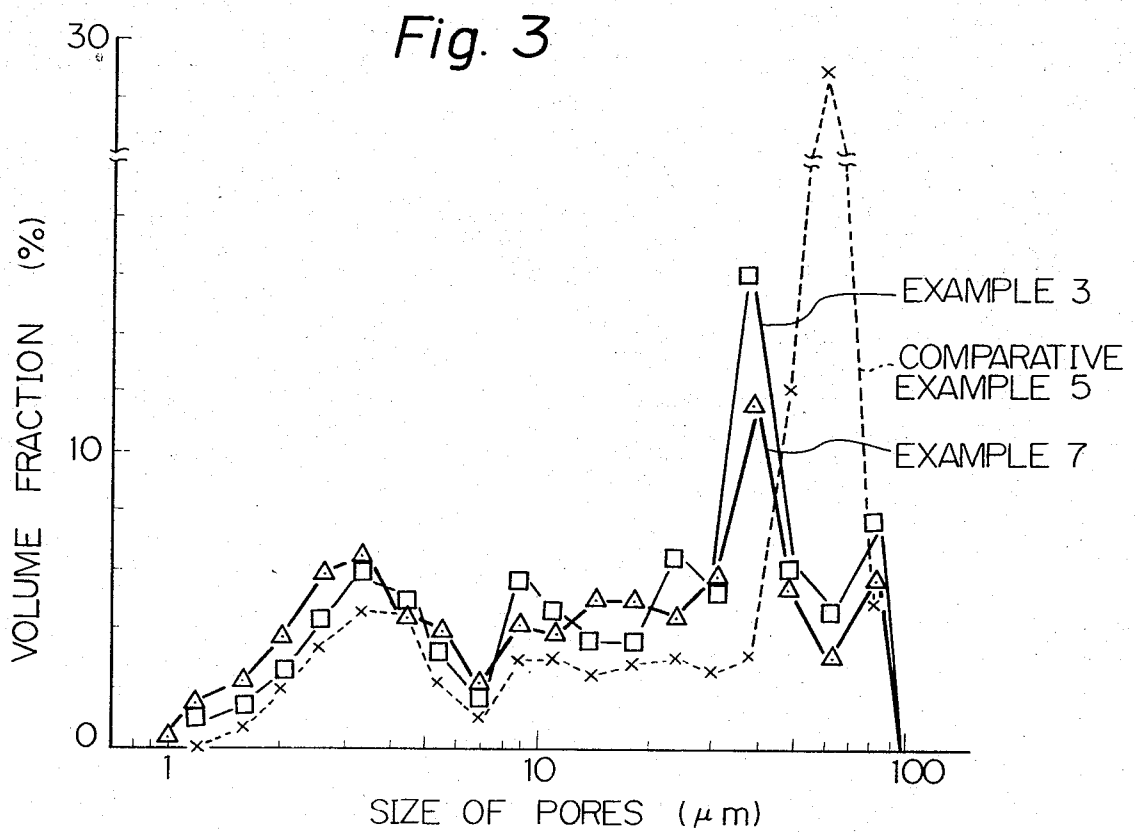

The pore size distribution determined with respect to various fabrics according to the mercury intrusion method, are shown in FIGS. 1, 2, and 3 of the accompanying drawings. In each figure, the peaks of the volume fraction appear at the sizes of the pores of 1 to 10 $\mu$m and of 20 to 100 $\mu$m. It is considered that these peaks correspond to the pores formed between the individual filaments and the pores formed between filament bundles. The integrated volume proportion of the pores having a predetermined size or more or less or a predetermined range of size is represented by a ratio (%) of the integrated volume thereof to the entire integrated volume of all the pores in the fabric.

The volume is expressed in the unit of cubic centimeters per gram of the fabric (ml/g).

When dust passes through a woven or knitted fabric, the larger the size of through pores in the woven or knitted fabric, the higher the permeability of dust through the fabric. Accordingly, in order to reduce permeation of dust, it is first of all important to decrease the size of the through pores. The largest pores in a woven or knitted fabric are the above-mentioned interfilament bundle pores (3) formed between filament bundles. Accordingly, it is important to reduce the size of these pores as much as possible. For this purpose, the pore size distributions in conventional fabrics utilized for making dust-free clothings was measured. As result, it was found that in each of the conventional fabrics, the integrated volume of pores having a size of about 50 $\mu$m or more is very large. Based on this fact, the approach taken was to improve the filtering property of conventional fabrics by reducing the size and integrated volume of these large-size pores. As factors having influences on the size and the integrated volume of the inter-filament bundle pores, there are densities of the yarns, the presence or absence of the calender treatment, the conditions of the calender treatment, the form of the yarn used (for example, a flat yarn or a textured bulky yarn), the weaving structure, and the finish density of the fabric. Since the finish density has direct influences on the inter-filament bundle pores, it is preferred that the finish density be increased as much as possible. If this finish density is too low, the inter-filament bundle pores become too large and the filtering property of the fabric is degraded. Ordinarily, the two-dimensional porosity of a woven fabric is represented by the cover factor. However, since this cover factor is not in agreement with the three-dimensional porosity of the fabric, it is difficult to represent the porosity of the fabric by the cover factor. The calender treatment exerts an effect of crushing the pores. Therefore, the calender treatment is a method customarily adopted for reducing the volume of the inter-filament bundle pores in a fabric and imparting a low air permeability to the fabric. This treatment is effective also in the present invention. The volume of the inter-filament bundle pores are variable depending on the weaving structure. Furthermore, when a fabric is greatly shrunk, for example, at the dyeing step, a fabric having a high density can be obtained. In the present invention, a woven or knitted fabric having a small volume of interfilament bundle pores can be obtained by adopting the above-mentioned means singly or in combination.

With respect to the various types of fabrics of the present invention and the conventional fabrics, the relationship between the pore size distribution and the dust-filtering property of the fabric was analyzed. As a result, it was found that a fabric in which the proportion of the integrated volume of pores having an inner size of 43 μm or more is 40% or less, based on the entire integrated volume of all the pores in the fabric, the resultant fabric exhibited an enhanced dust-filtering property. The term "inner size" referred to herein means the pore size determined according to the mercury intrusion method. In the present invention, since $\theta$ in the above equation (1) is set at 130° and $\sigma$ is set at 484 dyne/cm, for example, the inner size of 42.6236 μm corresponds to the pressure of 4.2 psia (pounds per square inch absolute) of mercury.

In the case of a fabric in which the integrated volume proportion of pores having an inner size of 40 μm or more exceeds 40%, the dust-filtering property of the fabric is not different from that of the conventional fabrics, and the dust-filtering property of the fabric is prominently improved when the above-mentioned integrated volume proportion is 40% or less. The dust-filtering property is more conspicuously improved when the above-mentioned integrated volume proportion is 25% or less. This effect is due to the fact that the integrated volume of the inter-filament bundle pores is reduced and the integrated volume of inter-filament pores providing a high dust-filtering effect is increased. Reduction of the integrated volume of the inter-filament bundle pores results in prevention of leakage of dust, and increase of the inter-filament pore results in increase of the dust-filtering efficiency of the fabric. A fabric having a very high dust-filtering property and an appropriate air permeability can be obtained only when the integrated volume of the interfilament bundle pores is reduced and the integrated volume of the inter-filament pores is much increased. In the present invention, the structural requirement to be satisfied for obtaining a fabric having a most highly improved dust-filtering property and an appropriate air permeability is that in the pore size distribution, the integrated volume proportion of pores having an inner size of 0.1 to 10 μm is 28% or more and the integrated volume proportion of pores having an inner size of 43 μm or more is 40% or less based on the entire integrated volume of all the pores in the fabric. In this fabric, as the integrated volume proportion of pores having an inner size of 0.1 to 10 μm is much larger than 28%, and the integrated volume proportion of pores having an inner diameter of 43 μm or more is much less than 40%, the dust-filtering property of the fabric is increased. Especially, a fabric having a structure in which the integrated volume proportion of pores having an inner size of 0.1 to 10 μm is larger than about 40% and the integrated volume proportion of pores having an inner diameter of 43 μm or more is about 10% or less has an appropriate air permeability and a very high dust-filtering property and is most preferred as the fabric useful for making dust-free clothing.

It is easy to obtain a fabric in which permeation of dust is completely prevented. This can be accomplished by depriving the fabric of the air permeability. If permeation of air through the fabric is not allowed, dust which is larger than molecules constituting air should not be allowed to pass through the fabric. However, when dust-free clothing is worn over an undergarment generating large quantities of dust and the personnel works in this state, if the number of dust particles having a size of not less than 0.3 μm is measured, the value of the number of dust particles in dust-free clothing made of a fabric having no substantial air permeability is not close to zero but is larger than the number of dust particles generated in dust-free clothing made from a fabric having air permeability. Even if dust-free clothing made of a fabric having no air permeability or having no substantial air permeability is worn, large quantities of dust are actually generated. With a view to clarifying the cause of this phenomenon, generation of dust was investigated while completely sealing the sleeve edges and neck portion of dust-free clothing made of a fabric having no substantial air permeability. It was found that generation of dust was drastically reduced. Accordingly, it was confirmed that in case of dust-free clothing of this type, since the fabric has no air permeability, entry and exit of air by the motion of the personnel are performed only through the openings in the sleeve edges and neck portion of the clothing and contaminated air is discharged directly from these openings. Accordingly, it is evident that the fabric for dust-free clothing should have appropriate air permeability. By the term "no substantial air permeability ", it is meant that the fabric has only a very small air permeability. An air permeability of about 0.2 to about 0.3 $cc/cm^2/sec$ or less as determined according to the Frazir method of JIS L-1079 is meant.

In a woven or knitted fabric, if the integrated volume of the inter-filament bundle pores is large, and therefore air permeation quantity is too large, in order to improve the dust-filtering property it is ordinarily preferred that the integrated volume of the interfilament bundle pores be reduced to an appropriate level. On the other hand, if the air permeability of a woven or knitted fabric is too low, the moisture permeation becomes insufficient and an uncomfortable feeling is given to a wearer. It is said that in order to moderate the uncomfortable feeling on wearing, it is necessary that the moisture permeability of a woven or knitted fabric be at least about 4000 g/m$^2$/24 hours. In order to impart the moisture permeability of this level to the fabric, it is necessary that air permeability of at least about 0.3 cc/cm$^2$/sec, preferably, at least 0.4 cc/cm$^2$/sec should be given to the fabric. If the air permeability exceeds 10 cc/cm$^2$/sec, the integrated volume proportion of the inter-filament bundle pores becomes too large and the dust-filtering property is reduced. Accordingly, it is indispensable that the air permeability of the fabric should not be higher than 10 cc/cm$^2$/sec.

In the fabric of the present invention, it is preferable that electrically conductive multi- or mono-filament yarns having an electric resistivity of $10^{10}$ Ω/cm or less, preferably $10^9$ Ω/cm or less, be incorporated into warps and/or a wefts at intervals in a range of from 3 mm to 50 mm. It is preferred that the diameter of the electrically conductive filament yarns be less than 100 μm, more preferably 60 μm or less. The electric resistivity referred to herein is the value measured by fixing both the ends of the filament yarn to aluminum foil by using an electrically conductive paste to form electrodes and applying a voltage of 100 V between the electrodes at a testing length of the yarn of 2 cm. Any of the electrically conductive filament yarns can be used in the present invention irrespective of the preparation process therefor, so far as the electric resistivity of the yarn is $10^{10}$ Ω/cm or less. More specifically, yarns of metal fibers, carbon fibers, and organic electroconductive fibers may be used in the present invention. The organic electroconductive fibers may be selected from products formed by coating the surfaces of synthetic fibers with carbon black or metal powder together with a resin (see Japanese Examined Patent Publication (Kokoku) No. 46-23799), composite fibers including a polymer containing carbon black or metal powder as one component (see Japanese Unexamined Patent Publication (Kokai) No. 48-48715), fibers having a metal complex formed therein by diffusion of a metal ion and fibers containing cuprous iodide in the interior thereof (see Japanese Unexamined Patent Publication (Kokai) No. 57-35004). The electrically conductive filament yarns were inserted into warps and/or a wefts at intervals in a range of from 3 mm to 50 mm in the fabric of the present invention. If the distance between the conductive yarns is larger than 50 mm, the resultant antistatic effect is sometimes unsatisfactory. If the distance is less then 3 mm, the resultant antistatic effect is saturated. In the present invention, fabric having or not having the electrically conductive filament yarns incorporated therein may be further treated with an antistatic agent, or antistatic synthetic filament yarns may be used as warps and/or wefts.

The electrostatic charge density of the antistatic fabric of the present invention is usually 7 μC/m$^2$ or less.

An increase of the denier of individual filaments is effective as means for increasing the integrated volume of inter-filament pores. However, in order to increase this volume, it is necessary not only to reduce the denier of the individual filaments but also to make contrivances on the interior structure of the filament bundle. In the case where the individual filaments are gathered substantially in parallel to one another in the filament bundle as in the case of a flat yarn, since the individual filaments are close to one another along the longitudinal direction, the volume of the pores between the individual filaments, that is, of the inter-filaments pores should inevitably be reduced. Even though the above-mentioned volume may be increased by reducing the denier of the individual filaments, this increase is limited in the case of a flat yarn. Accordingly, in the case of a fabric composed of flat yarns, even if the integrated volume of pores having an inner size of 43 μm or more is reduced as compared with this volume in the conventional fabrics and the denier of the individual filaments is reduced, the enhancement of the filtering capacity of the fabric is limited. Also, in order to further enhance the dust-filtering property of the fibric, it is necessary to drastically reduce the air permeability thereof. In order to enhance the dust-filtering property of the fabric, it is preferred that the integrated volume of the pores formed between the filament bundles be reduced, the denier of the individual filaments be reduced, and the integrated volume of pores having an inner size in a range of from 1 μm to 10 μm be further increased, so that dust can be filtered through the pores formed between the individual filaments, that is, the inter-filament pores. A fabric having a large integrated volume of pores having the above-mentioned inner size can be prepared, for example, according to the following methods.

(1) A fabric is produced by weaving crimped multifilament yarns (for example, false-twisted yarns) consisting of individual filaments having a denier of about 1 used as warps and wefts. In order to reduce the integrated volume of the inter-filament bundle, weaving procedures are carried out so that the densities of the warps and wefts are as high as possible. The obtained fabric is then scoured and dyed according to customary procedures and is calendered by a compressing hot roll. The temperature of the hot roll is about 150° C. to about 220° C. and the pressure is about 10 to about 80 kg/cm$^2$. If necessary, the fabric is subjected to cam-fit processing to soften the touch of the woven fabric. In this woven fabric, the integrated volume proportion of pores having an inner size of 43 μm or more is lower than that of the conventional fabrics, and the integrated volume proportion of pores having an inner size in a range of from 1 μm to 10 μm is higher than that of the conventional fabrics.

(2) A fabric is obtained by weaving by using, as warps, polyester multi-filament yarns consisting of individual filaments having a denier of 1 or less and, as wefts, separable hollow composite filament yarns in which a polyester filamentary component and a polyamide filamentary component are arranged in the multi-annular configuration adjacent to each other and they are extended in the longitudinal direction of the yarn to form a tubular structure as a whole. The denier of the respective components of the hollow composite filament yarns is in a range of from 0.001 to 0.8. This fabric is scoured and dyed according to customary procedures. The fabric is subjected to a splitting treatment. The splitting treatment is accomplished, for example, by immersing the fabric in an aqueous emulsion of phenylphenol compounds, benzyl alcohol, chlorobenzene compounds, alkylbenzene compounds, or diphenyl compounds at a temperature of about 10° C. to about 40° C. Then, the fabric is calendered by a pressing hot roll. The temperature of the pressing hot roll is about 130° C. to about 180° C., and the pressure is about 10 to about 80 kg/cm$^2$. Since the nylon-6 filamentary components are greatly shrunk at the splitting treatment and the dyeing step, the density of the fabric is greatly increased and the denier of the individual filaments is remarkably reduced by splitting. A great difference of the length is produced between the polyester filamentary component and the nylon-6 filamentary component. Accordingly, a fabric in which the integrated volume of the inter-filament bundle pores is very small and the integrated volume of the inter-filament pores is very large is obtained.

(3) In the above-mentioned method (2), the separable composite filament yarn is used only as wefts, but it is preferred that this separable composite filament yarns be used as both the warps and the wefts. The splitting treatments are conducted in the same manner as in method (2). The structure of the obtained woven fabric is preferable to the structure of the woven fabric obtained according to method (2).

(4) The above-mentioned separable composite filament yarn mentioned in method (2) is twisted at a twist number of 1500 to 3500 T/M at room temperature to partially split the peripheral portions of the composite filament yarns contacting each other. Then, weaving and processing are carried out as in methods (2) or (3). Since partial splitting is effected before weaving, the splitting can be easily done by the splitting treatment conducted after weaving, and the final splitting degree is higher than in method (2) or (3).

(5) The composite filament yarn used in method (2) is subjected to a compressed air jetting treatment (for example, under a compressed air pressure of 4 kg/cm$^2$ at room temperature at an overfeed rate of 10%), and the resulting interlaced yarns are woven and processed as in method (2) or (3) (see Japanese Patent Application No. 58-189997).

(6) A woven fabric prepared according to method (2) or (3) is subjected to a wet heat treatment at a temperature of 50° C. or more before the splitting treatment, and the fabric is then subjected to the splitting treatment.

(7) The composite filament yarns described in method (2) are subjected to a texturing procedure, for example, are false-twisted at a heater temperature of about 180° C. The textured yarns are connected to a woven fabric. The fabric is finished in the same manner as that described in method (2).

The following effects can be attained by the present invention.

(1) Since the woven or knitted fabric of the present invention is composed of continuous multifilament yarns, generation of dust from the fabric per se is small.

(2) Since the fabric of the present invention has a dense structure in which the integrated volume of large pores or pores having a low dust-collecting efficiency and allowing permeation of dusts is small and the integrated volume of small pores having a high dust-collecting efficiency is large, the dust-collecting efficiency of the fabric is much higher than that of the conventional fabrics.

(3) Since the fabric of the present invention has an appropriate air permeability and a high dust-collecting efficiency, (a) the dust-preventing effect of the resulting dust-free clothing is high and (b) no uncomfortable feeling is caused on wearing.

(4) The fabric of the present invention is soft and has a soft touch, and dust-free clothing made of this fabric has excellent comfort and touch.

(5) Since the fabric of the present invention is not coated or laminated with a resin, the fabric is excellent in the washing resistance and the abrasion resistance, gives no unconfortable feeling on wearing and has a soft touch, and excellent comfort and touch to the skin.

(6) When electrically conductive filament yarns are incorporated, the dust-proof fabric of the present invention exhibits not only a high dust-filtering property but also a high antistatic effect.

(7) The fabric of the present invention can be utilized for making dust-free clothing, sterile clothing, dust-preventive clothing, and clothing to be used in a clean room, such as hoods, head caps, hats, shoes, socks, boots, mask, gloves, undergarments, inner suits, and aprons.

The present invention will now be described in detail with reference to the following examples. Incidentally, in the present invention, the properties of the fabrics are evaluated according to the following methods.

(1) Integrated volume of pores in relation to the size of the pores

A mercury intrusion porosimeter (trademark: Micromeritics Auto Pore 9200, made by Shimazu Seisakusho K. K.) was used as the measurement device. The mercury pressure was in a range of from 1.9 to 60,000 psia (corresponding to the size of pores of 94 to 0.003 μm). Within the above-mentioned range, 43 levels of the pressure were set. The weight of the specimen was 3 g. It was presumed that the contact angle of mercury was 130° and the surface tension of mercury was 484 dyne/cm. The pore size was calculated according to the equation (1). The entire integrated volume of all the pores in a fabric refers to the sum of the volumes of pores having an inner size of 0.003 μm (corresponding to a mercury pressure of about 60,000 psia) or more in the fabric. The entire integrated volume of all the pores was expressed in the unit of volume (ml) per gram of the fabric (ml/g). The integrated volume proportion of the pores having an inner size of 43 μm or more was represented in percent thereof based on the entire integrated volume of all the pores in the fabric. The integrated volume proportion of pores having an inner size in a range of from 0.1 μm to 10 μm was determined by substracting the integrated volume of pores having an inner size of 9.8585 μm or more from the integrated volume of pores having an inner size of 0.0937 μm or more, and expressed in percent based on the entire integrated volume of all the pores in the fabric. In each volume fraction diagram in FIGS. 1 through 3, the size of pores means an average pore size. The volume fraction refers to the integrated volume of pores having sizes corresponding to mercury pressures in the range between two adjacent two levels from which the average pore size was calculated.

(2) Dust-collecting efficiency ($\eta$) of fabric

The dust-collecting efficiency of the fabric was evaluated in an air-conditioned room where the fluctuation in concentration and particles size distribution of dust in air was small. A fabric specimen was attached air-tight to a stainless steel funnel having an effective diameter of 18 cm. A conduit connected to the funnel was connected to a dust counter (Trademark: Model 4100 made by Dan Kagaku K. K.) through a plastic tube. The dust counter was actuated, the sample air suction rate was adjusted to 0.3 litter/min (or l/min) or 1.0 l/min, and air which had been filtered by the fabric was sucked into the dust counter and the amount (n) of dust having a size of 0.3 μm or more was counted. The amount ($n_o$) of dust having a size of 0.3 μm or more at room temperature had been separately counted. The dust-collecting efficiency was calculated according to the following equation (2):

$$\eta=(n_0-n)/n_0 \quad (2)$$

At the time of measurement of n, the pressure in the funnel (at a place close to the fabric surface) is simultaneously measured by a manometer, and the difference (pressure drop, $mmH_2O$) between the measured pressure and the atmospheric pressure was determined. The lower the air permeability of the fabric, the higher the pressure loss. Accordingly, if the filtration rate was constant, the pressure loss corresponded to the air permeability of the fabric. When the air suction rate in the counter was adjusted to 0.3 μ/min or 1.0 l/min, the filtration rate was 0.02 cm/sec or 0.066 cm/sec. When the difference in pressure between the space between the dust-free clothing and the undergarment at the time of actual working on wearing of the dust-free clothing and the space outside the dust-free clothing was measured in advance by the above-mentioned manometer, it was found that this pressure difference was smaller than 0.4 $mmH_2O$.

(3) Air permeability

The air permeability was determined according to the Frazir method of JIS L-1096.

(4) Moisture permeability

The moisture permeability was determined according to the cup method of JIS L-0208 (at a temperature of 40° C. and a relative humidity of 90%).

(5) Dust-preventive effect of dust-free clothing

A box having an inner capacity of 0.7 $m^3$ having an air inlet arranged in the ceiling portion and an air outlet arranged at a lower part of the side wall was placed in a clean bench having a cleanness of class 100 or less. A person wearing dust-free clothing enters into this box and the quantity of dust generated due to the motions of the person was measured by the above-mentioned dust counter. The air cleanliness, (hereinafter referred to as "B/G") of the box before entrance of the person is substantially equal to that in the clean bench containing 3 to 4 dusts having a size of 0.3 μm or more per liter. The person wore a commercially available cotton shirt below the dust-free clothing and also wore boots, a hood, and gloves for a dust-proof room. The dust-free clothing, boots, and other goods used were anti-electrostatic articles made by using electrically conductive yarns. The motions of the person conducted in the box were stamping and hand swinging (both the feet are kept on the ground). The frequency of each motion was 90 times per minutes. Dust generated by the motions of the person in the box flowed out from the air outlet together with an air current. The amount of dust was measured at the center of the air outlet and the amount of dust generated was determined by subtracting B/G from the counted number. Incidentally, when the above-mentioned stamping was carried out in the state where only the undergarments (cotton briefs and cotton long-sleeved shirt) were worn, the amount of generated dust was as large as 7160 per liter.

(6) Thickness of fabric

The thickness of a fabric was measured according to the method of JIS L-1079.

(7) Electrostatic charge density

The electrostatic charge density was determined according to the chargeability test method (Faraday gauge method) for antistatic working clothes, described in Recommended Standards of Construction of Appliances used for Protection against Electrostatic Hazards, February, 1983, pages 154 through 161, issued by Research Institute of Industrial Safty, Japan. The test was conducted at a temperature of 20° C. and a relative humidity of 30%. Nylon and polyacrylonitrile fabrics were used as standard fabrics.

EXAMPLE 1

A green plain weave was produced by using, as warps, polyethylene terephthalate multi-filament yarns having a yarn count of 75 de/72 fil and a twist number of 250 T/M and doubled yarns formed by doubling and twisting, at a twist number of 250 T/M the above-mentioned yarns and electroconductive yarns (Trademark: Metalian, supplied by Teijin Limited) having, denier of 22 and an electric resistivity of $8\times10^5$ Ω/cm and, as weft untwisted polyethylene terephthalate multi-filament yarns having a yarn count of 64 de/144 fil. In this fabric, the doubled yarns of the polyethylene terephthalate multi-filament yarn and the electrically conductive filament yarn were incorporated into the warps at intervals of 0.6 cm. The fabric was desized, scoured, and dried and was then preset at 180° C. The fabric was subjected to dyeing procedures with 2% owf of a fluorescent brightening agent (Trademark: Mikawhite ATN made by Nippon Kayaku K. K.) (2% owf) by using a rapid circulator dyeing machine at a temperature of 135° C. The dyed fabric was dried and finally heat-set at 170° C. Then, the fabric was calendered with a hot roll at a temperature of 170° C., under a linear pressure of 30 $kg/cm^2$ at a fabric speed of 15 m/min and was then subjected to a cam-fit treatment at a temperature of 100° C. at a fabric speed of 20 m/min to produce a fabric usable for dust-free clothing. The properties of the resultant fabric are shown in Table 1, the volume fractions relative to various sizes of pores are shown in Table 2, the pore size distribution is shown in FIG. 2, and the dust-filtering property of the fabric is shown in Table 3. The dust-preventive property of an overall type dust-free clothing formed by using this fabric is shown in Table 4. The electrostatic charge density of the fabric is shown in Table 5.

EXAMPLE 2

A fabric for dust-free clothing was prepared in the same manner as described in Example 1 except that the warps consisted of false-twisted polyethylene terephthalate multi-filament yarns having a yarn count of 75 de/72 fil and having a twist number of 250 T/M, and doubled yarns formed by doubling and twisting, at a twist number of 250 T/M the above-mentioned yarns and the Metalian yarns and the wefts consisted of false-twisted, untwisted polyethylene terephthalate multifilament yarns having a yarn count of 75 de/72 fil. The properties of the resultant fabric are shown in Tables 1, 2, 3, and 5 and in FIG. 2.

EXAMPLE 3

A fabric for dust-free clothing was produced in the same manner as described in Example 1, except that the weave structure was changed to a ½ twill structure. The properties of the resultant fabric are shown in Tables 1, 2, and 3 and FIG. 3.

EXAMPLE 4

A fabric for dust-free clothing was produced in the same manner as described in Example 2, except that the twill weave structure and the densities of warps and wefts were changed to as shown in Table 1. The properties of the resultant fabric are shown in Tables 1, to 5 and in FIG. 2.

EXAMPLE 5

A fabric for dust-free clothing was prepared in the same manner as described in Example 1 except that the type of wefts and the densities of warps and wefts were changed to as shown in Table 1. The properties of the resultant fabric are shown in Tables 1, 2, 3 and 5 and in FIG. 2.

EXAMPLE 6

(1) Preparation of Woven Fabric

By using a polyethylene terephthalate having an intrinsic viscosity of 0.62 (as measured at 35° C. in o-chlorophenol) and a poly-ε-caproamide having an intrinsic viscosity of 1.30 (as measured at 35° C. in m-cresol), there was prepared hollow composite filaments in which the above-mentioned polyester and polyamide components in the number of 16 were arranged alternately and adjacently to each other in the form of annulets and were extended in the longitudinal direction of the filaments to form a tubular structure as a whole (see Japanese Unexamined Patent Publication (Kokai) No. 51-70366). In the resultant composite filament yarn, the weight ratio of the total polyamide component to the total polyester component was 1/1, and the denier of each component filament was 0.23. The thickness of the composite filament yarn was 3.7 denier. The hollow ratio, that is, the ratio of the volume of the hollow portion to the sum of the entire volumes of the polyamide components, the polyester component, and the hollow portion was 8%.

A plain weave fabric (taffeta) having a warp density of 105 yarns/inch and a weft density of 73 yarns/inch was prepared by using, as wefts, the above-mentioned composite multifilament yarns (150 denier/40 filaments, untwisted) and, as warps, polyethylene terephthalate multifilament yarns (75 denier/72 filaments, a twist number of 300 T/M) and a doubled yarn formed by doubling and twisting, at a twist number of 200 T/M, the abovementioned polyethylene terephthalate multifilament yarns and copper iodide-containing polyethylene terephthalate monofilament yarns having an electric resistance of $2\times10^8$ Ω/cm (supplied by Teijin Limited) and a denier of 22. The intervals of the electrically conductive yarns was 0.8 cm.

(2) Processing of Woven fabric

The resultant woven fabric was subjected to a wet heat treatment at 90° C. for 20 minutes in a treating bath containing 1 g/l of soda ash and 1 g/l of a detergent (Trademark: Scourol 400, made by Kao-Atlas) by using a circular dyeing machine (made by Hisaka Seisakusho K. K.). Then, the fabric was treated in the rope-like form at 30° C. for 30 minutes with a 1% emulsion of a treating agent (Trademark: Tetrosin OE-N, made by Yamakawa Yakuhin K. K. and containing 36% of o-phenylphenol) by using the circular dyeing machine (the liquor ratio was 1/30).

Then, the woven fabric was scoured at 90° C. for 20 minutes in a scouring bath containing 5 g/l of soda ash and 1 g/l of Scourol 400, heat-set at 170° C. for 30 seconds, and dyed at 130° C. for 60 minutes in an aqueous dyeing bath containing 4% a disperse dye (C.I. 63305, Trademark: Duranol Blue G made by ICI), 0.2 ml/l of acetic acid, and 1 g/l of a dispersant composed mainly of a condensation product of naphthalene-sulfonic acid with formamide. Then, the dyed fabric was subjected to a soaping procedure with an aqueous solution of a non-ionic detergent at 80° C. for 20 minutes and dried at 120° C. for 3 minutes.

Then, the fabric was calendered at 170° C. under a pressure of 20 kg/cm$^2$ by using a hot roll. The properties of the resultant fabric are shown in Tables 1, 2, 3, and 5 and FIG. 1. In the resultant fabric, the interval of the electrically conductive filament yarns was 0.6 cm.

COMPARATIVE EXAMPLE 1

A green 2/1 twill fabric was produced by using, as warps, polyethylene terephthalate multifilament yarns having a yarn count of 75 de/36 fil and a twist number of 154 T/M and doubled yarns formed by doubling and twisting, at a twist number of 200 T/M, the above-mentioned multifilament yarns, and carbon-type electroconductive filament yarns (Trademark: Metalian made by Teijin Limited) having a denier of 22 and an electric resistance of $8\times10^5$ Ω/cm and, as wefts, false-twisted, untwisted polyethylene terephthalate multifilament yarns having a yarn count of 100 de/24 fil. In this fabric, the doubled yarns composed of the polyethylene terephthalate yarns and the electroconductive yarns were incorporated at intervals of 2 cm into the warps. The fabric was desized, scoured, and dried and was then preheat-set at 200° C. The fabric was subjected to a fluorescent brightening process with 2% owf of a brightening agent (Trademark: Mikawhite ATN (made by Nippon Kayaku K. K.) by using a liquid flow dyeing machine at 130° C. The dyed fabric was dried and finally heat-set at 180° C. to obtain a fabric usable for dust-free clothing. The properties of the fabric are shown in Tables 1 to 4 and FIG. 1.

COMPARATIVE EXAMPLE 2

A fabric for dust-free clothing was prepared in the same manner as described in Comparative Example 1 except that the polyethylene terephthalate filaments had a triangular cross-sectional profile and a yarn count of 100 de/48 fil were used as the warps, polyethylene terephthalate multifilament yarns having a triangular cross-sectional profile and a yarn count of 100 de/48 fil were used as the wefts, and the weave structure was changed to a plain weave. The properties of the resultant fabric are shown in Tables 1 to 4 and FIG. 1.

COMPARATIVE EXAMPLE 3

A piece for a clothing was cut out from a commercially available dust-proof fabric. This fabric had a 3/2 twill structure in which polyester multifilament yarns of 82 de/36 fil were used as warps at a density of 160 yarns/inch and polyester multifilament yarns of 83 de/72 fil as wefts at a density of 127 yarns/inch. Electrically conductive filament yarns were incorporated into the warps at an interval of 0.45 cm. The surface of this woven fabric was coated with a water-proof moisture-permeable resin in a thickness of about 15 μm. The weight of this fabric was 118 g/m$^2$ and the thickness of the fabric was 0.115 mm. The fabric had an air permeability of 0.2 cc/cm$^2$/sec and a moisutre permeability of 3000 g/m$^2$/24 hours. Both the air permeability and the moisture permeability of the fabric were unsatisfactory. The properties of the fabric are shown in Tables 1, 3, and 4.

COMPARATIVE EXAMPLE 4

A composite fabric was prepared by laminating a water-proof, moisture-permeable polyurethane resin film on the back surface of the fabric prepared in Example 1. The properties of the resultant composite fabric are shown in Tables 1 to 4.

COMPARATIVE EXAMPLE 5

A green 2/2 twill weave fabric was prepared by using, as warps, polyethylene terephthalate multifilament yarns having a yarn count of 100 de/48 fil and twist number of 250 T/M and doubled yarns formed by doubling and twisting at a twist number of 250 T/M, the above-mentioned polyethylene terephthalate multifilament yarns and the electrically conductive carbon filament yarns and, as wefts, polyethylene terephthalate multi-filament yarns having a yarn count of 75 de/36 fil. The fabric was processed in the same manner as described in Comparative Example 2. The properties of the resultant fabric for dust-free clothing are shown in Tables 1 to 3 and FIG. 3.

COMPARATIVE EXAMPLE 6

A piece of fabric was cut out from a commerically available dust-proof fabric. This fabric had a herringbone twill structure and comprised polyethylene terephthalate multifilament yanrs as the warps and wefts. In this fabric, no electrically conductive filament yarn was used. The air permeability of the fabric was 3.7 cc/cm$^2$/sec. The properties of this fabric are shown in Tables 3 and 5.

COMPARATIVE EXAMPLE 7

A piece of fabric was cut out from a commercially available dust-proof fabric. The fabric was a plain weave fabric comprised polyethylene terephthalate multifilament yarns as both the warps and wefts. The electrically conductive filament yarns were incorporated into the warps at intervals of 1 cm. The air permeability of the fabric was 12.1 cc/cm$^2$/sec. The dust-filtering property of the fabric is shown in Table 3. It was confirmed with the naked eye that the cavities in the weave texture were as large as in the fabric of Comparative Example 1, even if the pore diameter distribution was not measured.

COMPARATIVE EXAMPLE 8

A piece of fabric was taken out from a commercially available dust-proof fabric. This fabric had a 2/1 twill structure composed of polyethylene terephthalate multifilament yarns as both the warps and wefts, and the electrically conductive filament yarns were incorporated at an interval of 1 cm into the warps. The air permeability of the fabric was 13.0 cc/cm$^2$/sec. It was observed with the naked eye that the pores formed in the weave structure were as large as in the fabric of Comparative Example 1, even if the pore size distribution was not measured.

COMPARATIVE EXAMPLE 9

A piece of fabric was cut out from a commercially available dust-proof fabric. The fabric had a 2/2 twill weave structure comprising, as the warps, polyethylene terephthalate multifilament yarns having a yarn count of 162 de/48 fil at a density of 128 yarns/inch and, as the wefts, polyethylene terephthalate multifilament yarns having a yarn count of 65 de/36 fil at a density of 110 yarns/inch, and the electrically conductive filament yarns were incorporated at intervals of 1.3 cm into the warps. The air permeability of the fabric was 1.7 cc/cm$^2$/sec. The dust-filtering property of the cut-out fabric is shown in Table 3. It was confirmed with the naked eye that the pores in the weave structure were as large as in the fabric described in Comparative Example 2.

COMPARATIVE EXAMPLE 10

A piece of fabric was cut out from a commercially available dust-proof fabric. This fabric had a 1/3 twill weave structure comprising, as the warps, polyethylene terephthalate multifilament yarns having a yarn count of 100 de/48 fil at a density of 125 yarns/inch and, as the wefts, polyethylene terephthalate multifilament yarns having a yarn count of 100 de/48 fil at a density of 99 yarns/inch, and the electrically conductive filament yanrs were incorporated at intervals of 0.6 cm into the warps. The air permeability of the fabric was 17.1 cc/cm$^2$/sec. The dust-filtering property of the cut-out fabric is shown in Table 3. It was confirmed with the naked eye that the pores in the weave structure were as large as in the fabric of Comparative Example 1, even if the pore size distribution of the fabric was not measured.

COMPARATIVE EXAMPLE 11

The back surface of a Nylon 6 fabric comprising, as warps, Nylon 6 multifilament yarns having a yarn count of 120 de/24 fil at a density of 144 yarns/inch and, as wefts, nylon 6 multifilament yarns having a yarn count of 120 de/24 fil at a density of 88 yarns/inch was coated with 4%, based on the weight of the fabric, of an acrylic resin. The weight of the treated fabric was 115 g/m$^2$, the thickness was 0.177 mm, and the air permeability was 0.37 cc/cm$^2$/sec. The dust-filtering property of the treated fabric is shown in Table 3. Though the air permeability of the fabric was poor, the dust-collecting property of the fabric was unsatisfactory. It is apparent that even if pores in the woven structure are filled with a resin to reduce the air permeability, the dust-collecting property is not so improved.

EXAMPLE 7

The fabric as described in Example 4 was calendered at a hot roll temperature of 180° C. under a linear pressure of 30 kg/cm at a roll speed of 0.5 m/min. The moisture permeability of the resultant fabric was 6000 g/m$^2$/24 hours, and the air permeability was 0.9 cc/cm$^2$/sec. The integrated volumes of the pores relative to the pore size are shown in Table 2, the pore size distribution is shown in FIG. 3, and the dust-collecting efficiency is shown in Table 4.

EXAMPLE 8

A plain weave fabric was prepared by using, as wefts, the same hollow composite multifilament yarns (150 denier/40 filaments, untwisted) as used in Example 1 and doubled yarns each formed by doubling and twisting, at a twist number of 200 T/M, the above-mentioned composite multifilament yarn and a copper iodide-containing, electrically conductive polyethylene terephthalate monofilament yarn having a denier of 22 and, as warps, polyethylene terephthalate multifilament yarns (75 denier/72 filaments, twisted at a twist number of 300 T/M) and doubled yarns each formed by doubling and twisting, at a twist number of 200 T/M, the above-mentioned polyethylene terephthalate multifilament yarn and the above-mentioned copper iodide-containing, electrically conductive polyethylene terephthalate monofilament yarn. In this fabric, the warp density was 105 yarns/inch and the weft density was 73 yarns/inch, and the electrically conductive polyethylene terephthalate monofilament yarns were incorporated at intervals of 0.8 cm into both the warps and wefts in a lattice pattern.

The same treatments as described in Example 1 were applied to the fabric. A dust-proof fabric in which the electrically conductive polyethylene terephthalate monofilament yarns were arranged in a lattice pattern at intervals of 0.6 cm was obtained.

EXAMPLE 9

A green plain weave fabric was prepared by using, as warps, polyethylene terephthalate multifilament yarns having a yarn count of 75 de/72 fil and a twist number of 250 T/M, and doubled yarns each formed by doubling and twisting, at a twist number of 250 T/M, the above-mentioned polyethylene terephthalate multifilament yarns and the electrically conductive carbon filament yarns (Metalian) having a denier of 22 and, as wefts, untwisted polyethylene terephthalate multifilament yarns having a yarn count of 64 de/144 fil yarns and doubled yarns each formed by doubling and twisting, at a twist number of 250 T/M, the above-mentioned polyethylene terephthalate multifilament yarn and the electrically conductive carbon filament yarn. The doubled yarns of the polyethylene terephthalate multifilament yarn and the electrically conductive carbon filament yarn were incorporated at intervals of 0.6 cm into both the warps and wefts. The same treatments as described in Example 1 were applied to the fabric. A fabric useful for dust-free clothing was obtained. The frictional charge density of this fabric is shown in Table 5.

COMPARATIVE EXAMPLE 12

A comparative fabric was prepared in the same manner as described in Example 1, except that the electrically conductive carbon filament yarns, (Metalian) were not incorporated. The frictional charge density of the fabric is shown in Table 5.

TABLE 1

Properties of Fabrics

| Example No. | Fabric: Structure (de/fil of warp × de/fil of weft) | Fabric: Type | Weaving density (yarns/inch) Warp | Weaving density (yarns/inch) Weft | Weight ($g/m^2$) | Thickness (mm) | Moisture Permeability ($g/m^2$/24 hours) | Air Permeability ($cc/cm^2$/min) |
|---|---|---|---|---|---|---|---|---|
| Example 1 | T75/72 × T64/144 | plain weave | 163 | 106 | 92 | 0.100 | 7400 | 1.4 |
| Example 2 | TW75/72 × TW75/72 | " | 155 | 94 | 94 | 0.111 | 7800 | 2.2 |
| Example 3 | T75/22 × T64/144 | 2/1 twill weave | 214 | 116 | 124 | 0.130 | 7400 | 3.8 |
| Example 4 | TW75/72 × TW75/72 | " | 215 | 114 | 129 | 0.151 | 7500 | 7.2 |
| Example 5 | T75/72 × T75/72 | plain weave | 169 | 108 | 107 | 0.105 | 6800 | 0.7 |
| Example 6 | T75/72 × TN150/40 (splitted to 16 components) | " | 148 | 85 | 133 | 0.149 | 7000 | 0.7 |
| Comparative Example 1 | T75/36 × TW100/24 | 2/1 twill weave | 186 | 95 | 108 | 0.133 | 7100 | 15.0 |
| Comparative Example 2 | TΔ100/48 × TΔ100/48 | plain weave | 102 | 70 | 99 | 0.130 | 7300 | 3.0 |
| Comparative Example 3 | resin-laminated fabric | — | 160 | 127 | 118 | 0.115 | 3000 | 0.26 |
| Comparative Example 4 | resin-laminated fabric | — | 163 | 106 | 113 | 0.170 | 2000 | below 0.2 |
| Comparative Example 5 | T100/48 × T75/36 | 2/2 twill weave | 170 | 107 | 125 | 0.138 | 7500 | 2.5 |

In Table 1, the abbreviations have the following meanings.

T: polyethylene terephthalate (PET) multifilament yarn

TN: PET and Nylon 6 hollow composite filament yarn, described in Example 6

W: false-twisted textured bulky yarn de: denier fil: the number of individual filaments Δ: triangular cross-sectional profile (unless especially indicated, the cross-sectional profile is circular).

TABLE 2

Integrated Volume of Pores Relative to Size of Pores

| Example No. | Entire integrated volume of all pores (ml/g) | % based on entire integrated volume: 0.9 μm–9.9 μm | 9.9 μm or more | 42.6 μm or more |
|---|---|---|---|---|
| Example 1 | 0.5120 | 33.1 | 53.0 | 15.4 |
| Example 2 | 0.5717 | 30.9 | 30.9 | 18.4 |
| Example 3 | 0.4333 | 43.4 | 38.9 | 14.6 |
| Example 4 | 0.6822 | 39.5 | 50.0 | 14.0 |
| Example 5 | 0.5667 | 28.7 | 55.5 | 20.6 |
| Example 6 | 0.5337 | 48.5 | 33.8 | 7.7 |
| Example 7 | 0.4783 | 33.3 | 49.9 | 14.5 |
| Comparative Example 1 | 0.5977 | 17.2 | 71.1 | 51.0 |
| Comparative Example 2 | 0.7422 | 13.6 | 76.6 | 43.1 |
| Comparative Example 3 | 0.5480 | 24.0 | 63.0 | 45.2 |

TABLE 3

Dust-Filtering Property

| Example No. | Filtration speed ($V_0$): Dust-collecting efficiency (η) 0.020 cm/sec | Dust-collecting efficiency (η) 0.066 cm/sec | Pressure loss (ΔP ($mmH_2$)) 0.020 cm/sec | Pressure loss (ΔP ($mmH_2$)) 0.066 cm/sec |
|---|---|---|---|---|
| Example 1 | 0.87 | 0.78 | 0.6 | 2.0 |
| Example 2 | 0.90 | 0.80 | 0.2 | 0.7 |
| Example 3 | 0.87 | 0.78 | 0.1 | 0.4 |
| Example 4 | 0.89 | 0.79 | 0.1 | 0.2 |
| Example 5 | 0.96 | 0.93 | 1.0 | 3.2 |
| Example 6 | 0.996 | 0.98 | 0.6 | 2.6 |
| Example 7 | 0.90 | 0.79 | 0.5 | 1.4 |
| Comparative | 0.65 | 0.45 | 0.0 | 0.1 |

TABLE 3-continued

| Example No. | Dust-Filtering Property: Filtration speed ($V_o$) — Dust-collecting efficiency ($\eta$) 0.020 cm/sec | Dust-collecting efficiency ($\eta$) 0.066 cm/sec | Pressure loss ($\Delta P$ ($mmH_2$)) 0.020 cm/sec | Pressure loss ($\Delta P$ ($mmH_2$)) 0.066 cm/sec |
|---|---|---|---|---|
| Example 1 | | | | |
| Comparative Example 2 | 0.75 | 0.63 | 0.0 | 0.2 |
| Comparative Example 3 | * | * | * | * |
| Comparative Example 4 | * | * | * | * |
| Comparative Example 5 | 0.70 | 0.65 | 0.0 | 0.2 |
| Comparative Example 6 | 0.50 | 0.42 | 0.0 | 0.1 |
| Comparative Example 7 | 0.48 | 0.38 | 0.0 | 0.1 |
| Comparative Example 8 | 0.51 | 0.31 | 0.0 | 0.1 |
| Comparative Example 9 | 0.65 | 0.58 | 0.0 | 0.2 |
| Comparative Example 10 | 0.56 | 0.48 | 0.0 | 0.1 |
| Comparative Example 11 | 0.55 | 0.54 | 16.6 | 70.0 |

Note:
*Since the air permeability is extremely low, the pressure loss $\Delta P$ is extremely increased at the measurement of the dust-collecting efficiency ($\eta$). As result, leakage of the dust from the seal is caused and the dust-collecting efficiency ($\eta$) cannot be measured.

TABLE 4

| Dust-Preventive Property of Dust-Proof Clothing | Number (dusts/1) of generated dusts having size of 0.3 μm or more — Motions | | |
|---|---|---|---|
| Example No. | Hand swinging | Hand swinging (Sealed) | Stamping |
| Example 1 | 26 | 34 | 30 |
| Example 4 | 45 | 43 | 33 |
| Example 6 | 5 | 7 | 11 |
| Comparative Example 1 | 125 | — | 61 |
| Comparative Example 2 | 69 | 61 | 30 |
| Comparative Example 3 | 111 | 19 | 60 |
| Comparative Example 4 | 36 | 16 | 37 |

TABLE 5

| Example No. | Electrostatic charge density* ($\mu C/m^2$) |
|---|---|
| Example 1 | 3.8 |
| Example 2 | 3.7 |
| Example 3 | 3.7 |
| Example 4 | 4.0 |
| Example 5 | 3.5 |
| Example 6 | 3.3 |
| Example 8 | 2.7 |
| Example 9 | 1.9 |
| Comparative Example 6 | 14.6 |
| Comparative Example 12 | 15.1 |

Note
*The density of the electrostatic charge was measured 5 times by rubbing the fabric with each of Nylon 6 and acrylic fabrics. The mean value is calculated, and the largest value between the mean value obtained with respect to the nylon fabric and the mean value obtained with respect to the acrylic fabric was indicated in the table.

From Table 2 and FIGS. 1 through 3 showing the relationship between the volume fraction of pores and the size of the pores in a fabric, it is understood that in each of the fabrics of the comparative examples, the size of the pores having a maximum volume fraction was 50 to 60 μm or larger and the volume fraction proportion of pores having a size of 42.6 μm or more is very large, while the integrated volume proportion of pores having a size in a range of from 0.1 μm to 9.9 μm is very small. In contrast, in each of the fabrics of the examples in accordance with the present invention, the size of pores having a largest integrated volume proportion is smaller than that in the comparative examples, and the integrated volume proportion of pores having a.size of 42.6 μm or more is drastically reduced and the integrated volume proportion of pores having a size in a range of from 0.1 μm to 9.9 μm is increased. Namely, in each of the fabrics of the comparative examples, the volume of the inter-filament bundle pores is large and the volume of the inter-filament pores is small. On the other hand, in each of the fabrics of the examples, the volume of the inter-filament bundle pores is drastically reduced and the volume of the inter-filament pores is increased. This characteristic is especially prominent in the fabric of Example 6. In short, the fabrics of the present invention have a structure having a higher dust-filtering property than the fabrics of the comparative examples.

With respect to the above-mentioned fabrics, the dust-collecting efficiency ($\eta$) and the pressure loss ($\Delta P$) were measured. The results are shown in Table 3. In the conventional fabrics for dust-free clothing, shown in Comparative Examples 1, 2, and 4 through 12, the value ($\eta$) is 0.75 at highest and is ordinarily in a range of from about 0.5 to about 0.6. In case of the conventional fabrics of Comparative Examples 3 and 4, the air permeability is so poor that the value ($\eta$) cannot be determind because of too high a pressure loss, and these fabrics are not suitable for making dust-free clothing. Furthermore, from the results of Comparative Example 11, it is seen that even if in order to reduce the air permeability, a coating resin is applied to a woven fabric and pores in the fabric are filled with the resin, a fabric having a high dust-collecting efficiency cannot be obtained. In contrast, in the fabrics of the examples in accordance with the present invention, the dust-collecting efficency is about 0.9 or higher. It is seen that the fabrics of the present invention are improved over the fabrics of the comparative examples in the dust-collecting efficiency. The dust-collecting efficiency of the fabric of Example 6 is especially high and about 1.00, and this fabric can collect substantially 100% of dust while allowing permeation of air. When the fabric of Example 5 is compared with the fabric of Example 6, it is seen that although the fabric of Example 6 has a lower pressure loss and a slightly lower air permeability, this fabric has a higher dust-collecting efficiency. It is considered that this is due to the fact that the integrated volume of the inter-filament pores in the fabric of Example 6 is large. In view of the results shown in Tables 1 in comparison with those of Table 3, it is found that the dust-collecting efficiency of the fabric tends to increase with reduction of the air permeability thereof, but in case of the fabric composed of the bulky textured yarn (the fabric of Example 4), the dust-collecting efficiency is high even though the air permeability is relatively high and it is seen that a woven fabric of a textured bulky yarn has a higher dust-collecting efficiency than that of a woven fabric made of non-textured yarns. Moreover, when the results shown in Table 2 are examined in combination with those shown in Table 3, as the integrated volume of pores having size of 42.6 μm or more is small, or as the integrated volume of pores having a size in a range of 0.1 to 9.9 μm is large, the dust-collecting efficiency of the fabric becomes high, and it is seen that there is established a close interrelation between the pore characteristic (structure) and the dust-collecting efficiency of the fabric.

Overall type dust-free clothing were prepared by using the fabrics shown in Table 4. The dust-proof properties of these dust-free clothing were examined by checking the generation of dust caused when this clothing were actually worn. When hand swinging and stamping motions were carried out, in case of the dust-free clothing of Examples 1, 4, and 6 and Comparative Examples 1 through 4, the amount of generated dust tended to decrease with reduction of the air permeability of the fabric. However, when the dust-free clothing of Comparative Examples 3 and 4 composed of a fabric having no substantial air permeability were worn, the amount of generated dust was increased on the contrary. When openings in the sleeve edges (both hands and both feet) and the neck portion of the dust-free clothing were sealed with a view to clarifying the cause of the above phenomenon and so as to prevent the discharge of the dust from these openings, the amount of generated dust was drastically reduced. Namely, in the dust-free clothing of Comparative Examples 3 and 4, since they had no air permeability, discharge of air caused by the motions was effected only through the openings in the sleeve edges and neck portion, and contaminated air was discharged outside directly through these openings.

From the foregoing results, it is clear that the fabric of the present invention having a certain air permeability and a high dust-filtering property is suitable as a fabric for making dust-free clothing. Since the fabrics of the comparative examples have a low dust-filtering property or too high or too low an air permeability, clothing made of these fabrics exhibits a poor dust-preventive property. Generation of dust from the dust-free clothing of Example 6 is very small. That is, the fabric of Example 6 is especially excellent as a fabric for making dust-free clothing. Moreover, although the fabric of Example 4 has a high air permeability, generation of dust from the dust-free clothing made of this fabric is small.

When generation of dust was examined, the comfort was simultaneously evaluated with respect to each dust-free clothing. With respect to each clothing, the same person dressed up for an operation in a clean room according to customary wearing procedures and performed the stamping motion for 6 minutes. The comfort was checked. The sweating state of the person after the stamping motion was such that the skin was slightly wet with sweat. From the test results, it was found that as the air permeability of the fabric of the dust-free clothing is lower, the uncomfortable feeling becomes stronger. In the dust-free clothing of Comparative Examples 1 and 2 and Examples 1, 4, and 6, there was no uncomfortable feeling at all or there was no substantial uncomfortable feeling. However, in the dust-free clothing of Comparative Examples 3 and 4, the uncomfortable feeling was extremely prominent and the sweating skin adhered stickily to the fabric, i.e., the comfort was poor. It is considered that the reason is that the fabrics of Comparative Examples 3 and 4 were insufficient in air permeability and moisture permeability.

In view of the quantities of electrostatic charge shown in Table 5, it is clear that in the fabrics of the comparative examples comprising no electrically conductive yarn, the quantities of the electrostatic charge are large and the antistatic property is insufficient, while in the fabrics of the examples in accordance with the present invention, the quantitites of the electrostatic charge are small, that is, less than 7 $\mu C/m^2$, and the antistatic property is excellent. The fabric of Example 8 comprising electrically conductive yarns in both the warps and wefts had an especially high antistatic effect.

We claim:

1. A dust-proof fabric comprising a plurality of filament yarns having a denier of from 20 to 400 and consisting of a plurality of individual filaments having a denier of 3.5 or less, which fabric has a number of pores formed therein and exhibits an air permeability of from 0.3 to 10 $ml/cm^2/sec$ and, in which fabric, the integrated volume proportion of the pores having a size of 43 μm or more corresponds to 40% or less of the entire integrated volume of all the pores.

2. The dust-proof fabric as claimed in claim 1, wherein the integrated volume proportion of the pores having a size of 43 μm or more is 25% or less based on the entire integrated volume of all the pores.

3. The dust-proof fabric as claimed in claim 1, wherein the integrated volume proportion of the pores having a size of from 0.1 μm to 10 μm corresponds to 28% or more of the entire integrated volume of all the pores.

4. The dust-proof fabric as claimed in claim 3, wherein the integrated volume proportion of the pores having a size of from 0.1 μm to 10 μm corresponds to 40% or more of the entire integrated volume of all the pores.

5. The dust-proof fabric as claimed in claim 1, which is in the form of a woven fabric composed of a plurality of warps and wefts consisting of the filament yarns.

6. The dust-proof fabric as claimed in claim 5, wherein the warps and/or wefts contain electrically conductive filament yarns having an electric resistivity of $10^{10}$ Ω/cm or less and arranged at intervals of from 3 mm to 50 mm.

7. The dust-proof fabric as claimed in claim 1, which fabric has a thickness of from 0.05 mm to 0.40 mm.

8. The dust-proof fabric as claimed in claim 1 or 5, wherein the denier of the individual filaments is 1.5 or less.

9. The dust-proof fabric as claimed in claim 8, wherein the denier of the individual filaments is 0.5 or less.

10. The dust-proof fabric as claimed in claim 1, wherein the individual filaments are selected from the group consisting of polyester filaments, polyamide filaments, polyaramide filaments, polyolefin filaments, polyvinyl polymer filaments, rayon filaments, cellulose acetate filaments, silk filaments, and glass filaments.

11. The dust-proof fabric as claimed in claim 9, wherein the individual filaments having a denier of 0.5 or less are ones prepared from peel-separating composite filaments composed of a polyester filamentary constituent and a polyamide filamentary constituent connected to each other by peel-separating the polyester and polyamide filamentary constituents from each other.

12. The dust-proof fabric as claimed in claim 1, wherein at least a portion of the filament yarns comprises bulky multifilament yarns.

* * * * *